United States Patent [19]

Himes, Jr. et al.

[11] Patent Number: 4,969,838

[45] Date of Patent: Nov. 13, 1990

[54] LATCH AND LOCKING HANDLE FOR AN ELECTRICAL CONNECTOR

[75] Inventors: John L. Himes, Jr., Hummelstown; James S. Hower, Harrisburg; James H. Wise, Palmyra, all of Pa.

[73] Assignee: AMP Incorporated, Harrisburg, Pa.

[21] Appl. No.: 394,591

[22] Filed: Aug. 16, 1989

[51] Int. Cl.[5] ..... H01R 13/627

[52] U.S. Cl. ..... 439/352; 439/353; 439/484

[58] Field of Search ..... 439/345, 347, 350, 357, 439/358, 372, 352, 353, 484

[56] References Cited

U.S. PATENT DOCUMENTS

| | | | |
|---|---|---|---|
| 4,241,965 | 12/1980 | Wilson et al. | 339/4 |
| 4,277,123 | 7/1981 | Haworth et al. | 339/22 R |
| 4,277,123 | 7/1981 | Haworth et al. | 339/22 R |
| 4,313,646 | 2/1982 | Millhimes et al. | 339/156 R |
| 4,367,370 | 1/1983 | Wilson et al. | 174/48 |
| 4,382,648 | 5/1983 | Propst et al. | 339/18 P |
| 4,453,792 | 6/1984 | Bright et al. | 339/64 R |
| 4,553,805 | 11/1985 | Aikens | 439/372 X |
| 4,582,378 | 4/1986 | Frucharo | 439/350 X |
| 4,666,223 | 5/1987 | Tillmann | 339/32 R |
| 4,708,413 | 11/1987 | Schrofoer | 439/358 |
| 4,714,433 | 12/1987 | Rider, Jr. | 439/357 X |
| 4,740,167 | 4/1988 | Millhimes et al. | 439/92 |
| 4,781,609 | 11/1988 | Wilson et al. | 439/215 |

OTHER PUBLICATIONS

Pp. 5-7 AMP Catalog 86-784, "Shielded CHAMP Connectors and Cable Assemblies", issued 4-87.
Esprit Seven Advertisement.

*Primary Examiner*—Neil Abrams
*Assistant Examiner*—Khiem Nguyen
*Attorney, Agent, or Firm*—Katherine A. Nelson

[57] ABSTRACT

A latch and combined latch locking means and handle for securing in place a plug-in electrical connector mated to a second connector. The latch comprises a latch plate pivotally joined to one end of the connector to permit deflection of the plate. A post is mounted on the receptacle at a position opposite the latch plate on the connector. Cooperating shoulders on the post and the latch plate restrain the connector from being withdrawn from the receptacle when the latch plate is in a first position. When the latch plate is deflected to a second position, the shoulders disengage to permit withdrawal of the connector from the receptacle. The latch locking means and handle comprises a bail pivotally mounted in the connector to permit the bail to be folded flush with the connector. In the flush position, the bail extends over the latch plate and prevents the plate from being deflected to a position disengaging the shoulders. When the bail is swung outward from the connector, the latch plate may be deflected to the release position and the bail serves as a handle to assist in withdrawing the connector from the receptacle.

7 Claims, 3 Drawing Sheets

LATCH AND LOCKING HANDLE FOR AN ELECTRICAL CONNECTOR

FIELD OF THE INVENTION

The present invention relates latch means for securing an electrical connector in place in a receptacle. More particularly, it relates to a latch and a handle for an electrical connector, the latch serving to secure the connector in place in a receptacle and the handle serving the dual-purposes of facilitating removal of the connector from a receptacle and of locking the latch to prevent undesired release of the connector from the receptacle.

BACKGROUND OF THE INVENTION

Copending application Ser. No. 07/394,775, filed Aug. 16, 1989, for "Power Distribution System for Modular Units", owned by the assignee of the present invention, discloses a system for prewiring modular furniture units so that the furniture units can be installed or relocated with power made readily available to the areas enclosed by the furniture by completing circuit connections in the prewired distribution system using plug-in components. Other power distribution systems for modular furniture units have been disclosed, for example, in U.S. Pat. Nos. 4,367,370, issued Jan. 4, 1983; 4,740,167, issued Apr. 26, 1988 and 4,781,609, issued Nov. 1, 1988.

Typically, these and still other power distribution systems for modular furniture such as wall panels, are installed in a wiring channel located within the panel. For purposes of illustrating the invention, the channels are shown extending along the bottom edge of a wall panel unit. It is to be understood that the location of the channel may be at other horizontal locations in the wall or be in a vertical orientation in a free standing post, for example. The wiring systems of adjoining panels in a panel run are connected together by flexible jumper cables having plug-in connectors at their opposite ends through which the like conductors of the wiring systems in each of the panels are interconnected. It is desirable that these connectors include latch mechanisms to hold the connectors in place in the receptacles to which they are mated to prevent dislodgement of the connectors when the furniture units are jostled during alignment for installation or when the units are subjected to excessive vibration. It is further desirable that the latch mechanisms be easily releasable so that adjoining units may be separated without difficulty for removal or relocation.

The above-referenced patent 4,740,167 discloses a panel power distribution system which makes use of junction boxes into which duplex outlet receptacles may be installed. The various junction boxes of the system are interconnected by multi-wire cables having connectors fitted to the ends thereof. The connectors attach to the junction box ends and releasable latches are provided at each connector for holding the connector and junction box in attachment The latch parts attached to a connector comprise two similar hasp-like plates pivotally mounted along the opposite sides of the connector near the connector end joined to the junction box. The forward ends of the plates are punctured by square holes which fit over and hook around sharp lipped ramps formed along the opposite sides of the junction box. No means are provided to lock the latch plates in engagement with the ramps to prevent undesired release.

The connector may be intentionally separated from the junction box by squeezing the ends of the connector latch plates toward one another to raise the eye ends above the junction box ramps while simultaneously applying force longitudinally to the connector. This operation is normally performed manually using only the force available through the fingers. The cramped space within the wiring channel of a panel unit in which the connector and junction box are located and the awkward position from which the operation must be performed makes separation of the connector from the junction box difficult. The operation becomes more difficult to perform as the number of contacts in a connector increases because of the increases in the force necessary to accomplish separation.

The above-referenced application Ser. No. 07/394,775 discloses a furniture power distribution system carrying ten conductors. The jumper cable connector used therein carries ten contacts, portions of each of which project beyond the rear face of the housing of the connector. The projecting portions of the connector contacts are surrounded by insulating silos to protect against accidental touch of the contacts during installation or removal of a connector from a power block of the system. The connector fits onto the end of an outward facing side of a power block with the insulating silos and the contact portions enclosed thereby extending into the interior of the power block. During removal of a connector from a power block it is important that the force applied to the connector for separation be directed straight outward away from the power block, since tilting or wiggling the connector during removal increases the removal force and could damage the silos.

It is an object of the invention to provide an easily releasable latch mechanism for holding an electrical connector in place in a receptacle.

It is another object of the invention to provide a latch mechanism having locking means to prevent unintentional release of the latch.

It is a further object of the invention to provide, for an electrical connector, a latch mechanism and locking means therefor, wherein the locking means serves the dual purposes of locking the latch and as a handle to aid in the removal of the connector from a receptacle.

SUMMARY OF THE INVENTION

Briefly, the present invention comprises a latch mechanism having locking means which is particularly suitable for use in holding a jumper cable connector in place in a power block of a power distribution system for a modular furniture unit. The latch mechanism comprises a latch plate pivotally mounted at the end of a first connector housing to permit deflection of the plate. The lower edge of the plate is formed with a bevelled lip that slopes to the outer edge of a shoulder extending across the plate near the lower end of the plate. A post is mounted on the second connector shown as a receptacle close to the edge of the position provided on the power black for installation of the cable connecter. The side of the post facing the connector position is formed with a ramp which slopes from the top of the post toward the connector position and ends in a sharp shoulder extending across the post above the base of the post. When the connector is mated with the receptacle, the lip edge of the latch plate rides over the post ramp until the shoulder of the latch plate passes over the post shoulder. Then the latch plate pivots outward from the connector end and latches the plate shoulder under the post shoulder.

The latch is released to permit separation of the first connector from the second connector or receptacle by deflecting the end of the latch plate opposite the lip end forward, thereby retracting the plate shoulder from under the post shoulder, and freeing the connector to be withdrawn from the receptacle.

The latch locking means of the invention comprises a generally U-shaped bail pivotally mounted to the connector to permit the bail to be swung flush into the connector housing with the mid-portion of the bail extending over the end of the connector and across the upper end of the latch plate. In this position of the bail, the upper end of the latch plate cannot be deflected forward to retract the plate shoulder from under the post shoulder and the latch is locked.

When the latch is to be unlocked, the bail is swung upward, away from the connector end, uncovering the upper end of the latch plate to allow the latch plate to be toggled forward and release the latch.

In this position, the bail serves as a convenient handle by which an adequate withdrawal force can be applied to the connector without difficulty and in the correct direction to prevent damaging parts of the connector.

DETAILED DESCRIPTION OF THE PREFERRED EMBODIMENT

Figure 1:
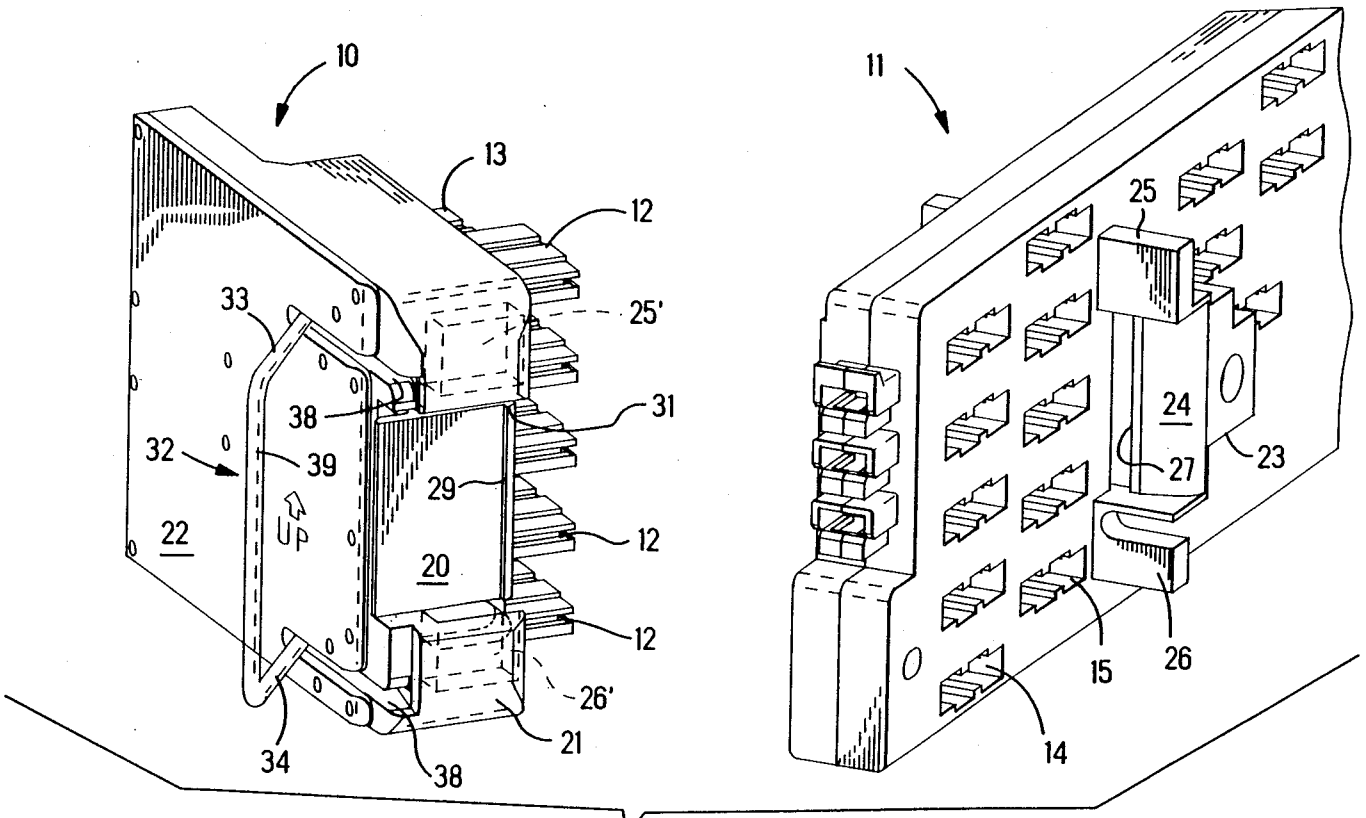
FIG. 1 is an isometric drawing of an electrical connector and receptacle used in a power distribution system for a modular wall panel incorporating the latch and locking handle of the invention.

FIG. 1 is an isometric drawing showing the locking mechanism and locking means therefor of the invention as applied to a jumper cable connector used in the power distribution system disclosed in the above-referenced application Ser. No. 07/394,775. The cable connector 10 is designed to mate with a power block 11 containing the conductors to be engaged by the contacts of connector 10. To better illustrate the latching mechanism of the present invention, power block 11 has been rotated with respect to cable connector 10. Portions of the contacts of the connector project through the rear face of the housing of connector 10 and are enclosed by insulating silos 12, 13 et al. Only several of the silos and none of the conductors of power block 11 or contact parts of connector 10 are seen in FIG. 1.

The connector contacts are arranged in two vertical columns and the portions of the contacts which project from the rear face of the connector housing, together with their enclosing silos, fit through openings 14, 15 et al. in the face of the housing of power block 11 near an end thereof. Openings 14, 15 et al are arranged in a pattern conforming to the pattern in which the connector contacts are arranged. The latch mechanism of the invention comprises two major parts. The first major part of the latch mechanism comprises a latch plate 20 pivotally joined to the end 21 of the connector housing 22. A second major part of the latch mechanism comprises a post 23 projecting outward from the face of the housing of power block II from a position adjacent the column of openings in the power block housing which includes opening 15. The mid-portion of the side of post 23 facing the end 21 of the connector is formed with a ramp 24 as best seen in FIG. 1.

Figure 2A:
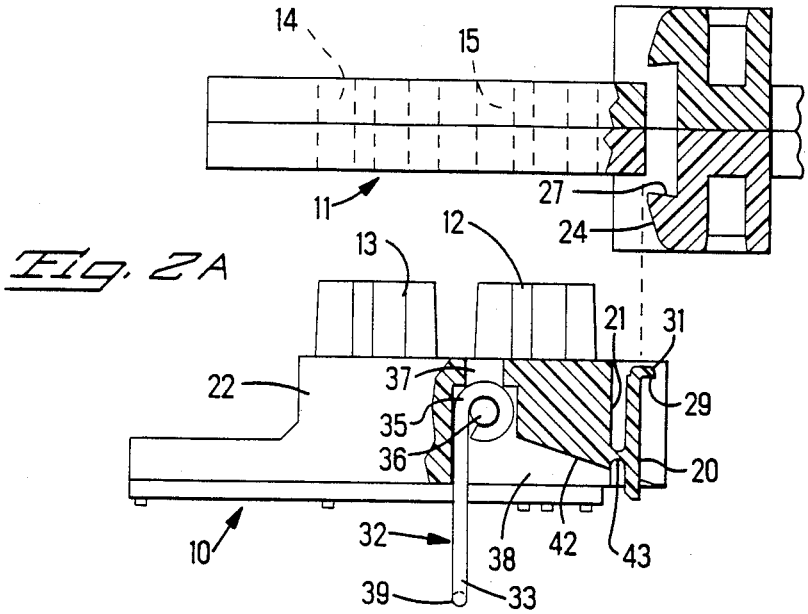
FIG. 2A is an elevation of the connector and receptacle shown in FIG. 1 with portions thereof broken away to show details of the construction of the latch and locking handle of the invention.

Wings 25 and 26 flank the ends of ramp 24. Ramp 24 slopes from its outer edge toward the end 21 of the connector and ends in a shoulder 27 spaced from the face of power block 11 as best seen in FIGS. 2A and 2C. The lower edge of latch plate 20 is finished with an outwardly projecting shoulder 29 with a bevelled edge 31. When the connector is fitted to the power block, the outer ends of wings 25 and 26 enter recesses 25', 26' (shown in phantom) in the rear face of the connector housing 22 to locate the connector silos 12, 13 et al. correctly with respect to the openings 14, 15 et al.; edge 31 rides over ramp 24 and passes over the ramp shoulder 27 as shown in FIG. 2B.

When the connector is fully mated to the power block, wings 25 and 26 are fully seated in the recesses of the connector housing, restraining the connector against longitudinal motion relative to the power block. Shoulder 29 on latch plate 20 snaps under shoulder 27 to hold the connector in place in the power block.

Figure 2B:
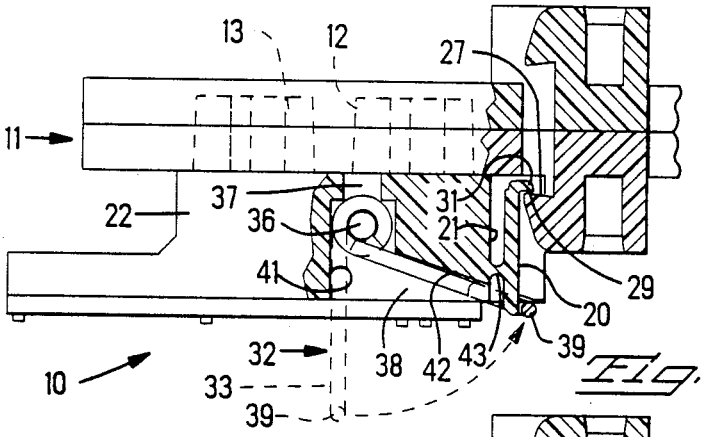
FIG. 2B is a view similar to FIG. 2A showing the connector installed in the receptacle and the handle in positions to lock and to unlock the latch.
Figure 2C:
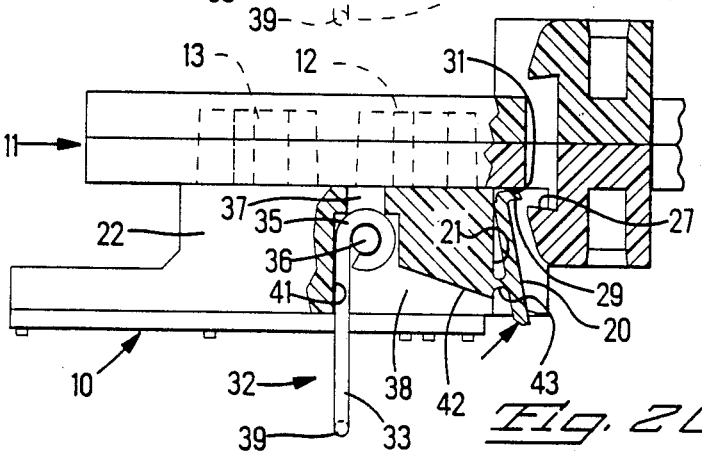
FIG. 2C is a view, similar to FIG. 2B with the handle in the unlocked position, showing the latch being released to permit separation of the connector from the receptacle.

The latch locking means of the invention comprises a generally U-shaped bail 32 having a straight mid-span 39 and two downwardly turned, parallel legs 33 and 34, as best seen in FIG. 1 Referring to FIGS. 2A–2C, the ends of legs 33 and 34 of bail 32 are formed into loops 35 and bail 32 is pivotally attached to the connector 10 by a pin 36 passed through the loop 35 at the end of leg 33 and the end of leg 34. Each of the two pins 36 is located in a straight walled, shouldered well 37 at about the middle of the depth of connector housing 22. The wells 37 are spaced apart laterally of the housing 22 along a line between the two columns of contacts and insulating silos 12, 13 et al., of connector 10. Grooves 38, open through the end 21 and outer face of the connector housing (see FIG. 1), slope from near the top edge of housing end 21 to intersect the wells 37 slightly above the level of pins 36. Bail 32 is therefore free to swing outward from the connector to a vertically erect position, as seen in FIG. 2A, or to swing flat against the connector housing with legs 33 and 34 of bail 32 being concealed in grooves 38 and with the portion 39 of the bail extending along the end 21 of the connector housing and over the upper end of latch plate 20 as seen in FIG. 2B. Travel of bail 32 is limited vertically by the walls 41 of wells 37 and limited horizontally by the floors 42 of grooves 38

FIGS. 2A–2C show the integral flexible hinge joint 43 by which the latch plate 20 is attached to the end 21 of the connector housing. Also seen in FIGS. 2A-2C are shoulder 27 at the lower end of ramp 24 on post 23 of power block 11 and shoulder 29 at the lower edge of latch plate 20. FIG. 2A shows the connector 10 separated from the power block 11. FIGS. 2B and 2C show the connector 10 fully mated to the power block 11.

FIG. 2B shows the connector latched to the power block by the engagement of shoulder 29 on latch plate 20 with shoulder 27 at the lower edge of ramp 24. FIG. 2B also shows the two limiting positions of bail 32. In the lower limiting position, span 39 extends over the upper edge of latch plate 20 and restrains the upper end of the latch plate against forward movement in the direction of ramp 24, thereby locking shoulders 27 and 29 in engagement. When bail 32 is swung outward from the connector and span 39 clears the top edge of latch plate 20, the latch is unlocked and the upper end of latch plate 20 is free to be moved forward, thereby swinging shoulder 29 from under shoulder 27 and releasing the latch to allow separation of the connector from the power block. FIG. 2C shows latch plate 20 in the latch release position.

Figure 3:
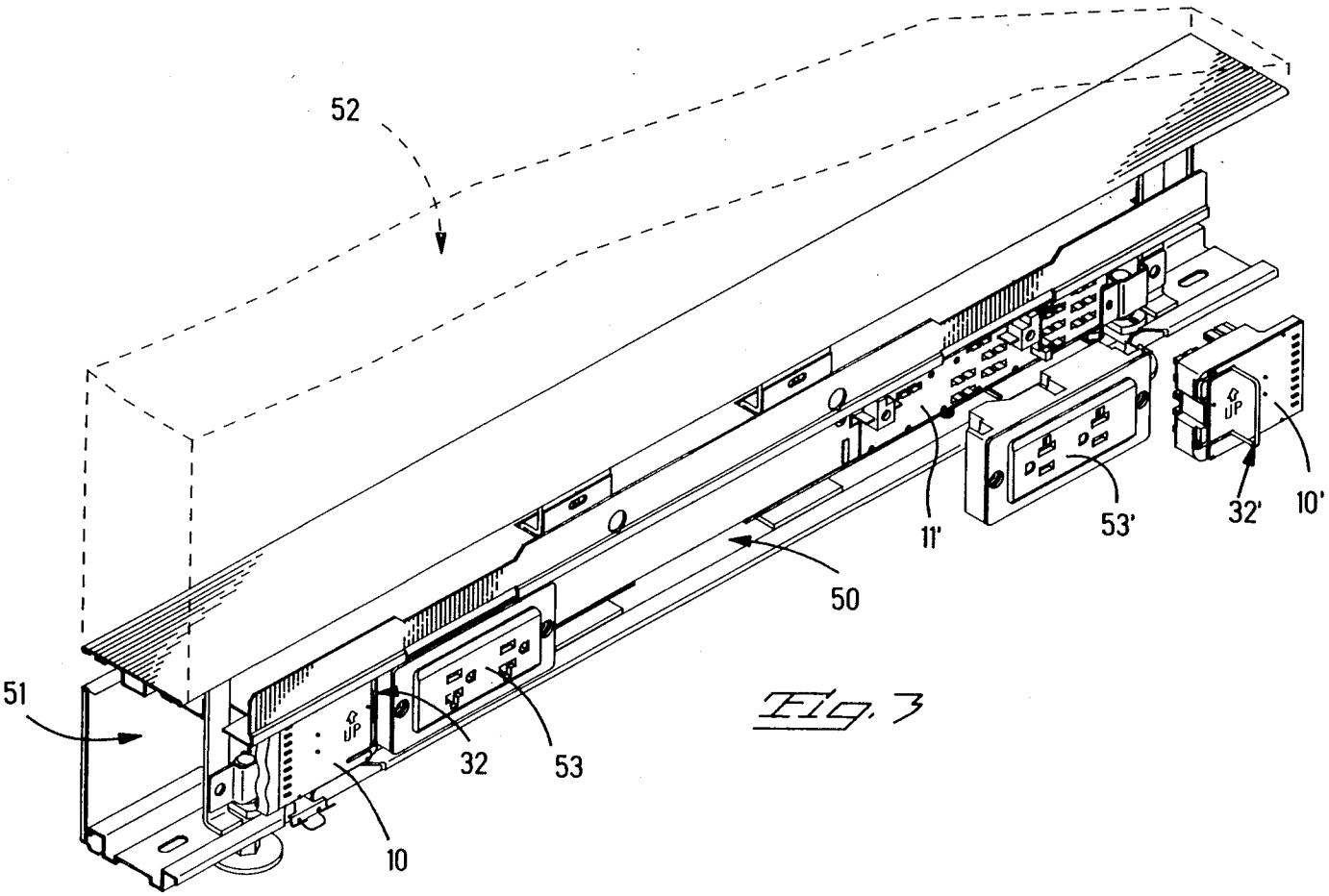
FIG. 3 is an isometric drawing of a wall panel power distribution system utilizing electrical connectors which incorporate the invention.

FIG. 3 shows the power distribution system 50 disclosed in application Ser. No. 07/394,775 installed in the wiring channel 51 that runs within the bottom edge of a modular wall panel unit 52.

A jumper cable connector 10 and a duplex outlet unit 53 are shown installed in the power block (not seen) of the system 50 located at the right end of wiring channel 51. A duplex outlet unit 53' and a jumper cable connector 10' are shown positioned for installation in the power block 11' of the system 50 located at the right end of wiring channel 51. Connectors 10 and 10' incorporate latch mechanisms and locking handles made in accordance with the present invention. The handle (bail) 32 of connector 10 is shown in the position in which the latch of the connector is locked. The handle 32' of connector 10' is shown in an open position. Connector 10 thus presents an outer face that is flush with the edge of wiring channel 51.

FIG. 3 demonstrates the cramped space available for the manipulation of a connector latch mechanism and makes evident the awkward position from which manual operations relating to a connector or other of the components of the system must be performed. FIG. 3 makes obvious the desirability of having a latch mechanism which is easily accessible and operable from the front face of the panel and the desirability of having a latch locking means which is likewise easily accessible and operable from the front face of the panel. These desirable characteristics are present in the invention.

Moreover, the latch locking means of the invention provides the added convenience of serving as a handle that permits application to the connector, without discomfort, of adequate force to separate the connector from the power block.

Obviously, many modifications and variations in the specific embodiment of the invention described herein are possible in the light of the above teachings. It is therefore to be understood that the invention may be practiced otherwise than as specifically disclosed without departing from the spirit and scope of the appended claims.

We claim:

1. A system for locking a first connector to a second connector in latched relationship, said connectors being of the type matable upon being moved together in a selected direction, said first and second connectors having means operative to restrain said mated connectors against relative motion in a direction orthogonal to said selected direction when said connectors are mated, said system comprising:

a latch plate of said first connector coextending parallel to said selected direction from a securing means forwardly to a free end, said free end including a rearwardly facing latch surface thereon, and said securing means pivotally joining said latch plate to one end of said first connector to permit deflection of said latch plate from a first position to a second position proximate said first connector in a manner transverse to said selected direction;

a post fixed to said second connector at a position opposite said latch plate when said first and second connectors are mated, said post including a rearwardly facing catch means;

said latch surface on said free end of said latch plate engaging said catch means to restrain said first and second connectors against relative motion opposed to in said selected mating direction when said latch plate is in said first position;

said latch surface disengaging said catch means to free said first and second connectors for relative motion in said opposed direction when said latch plate is deflected to said second position;

a U-shaped handle; and means for pivotally attaching said handle to said first connector to permit said handle to be moved to a position extending outwardly from said first connector for use as a handle, and to permit said handle to be moved to a flush position with respect to said first connector for use as a latch lock, a portion of said handle engaging a rearward portion of said latch plate when said handle is in said flush position to secure said rearward portion against lateral movement away from said first connector and prevent deflection of said latch plate to said second position.

2. A system as claimed in claim 1, wherein:

said second connector includes a planar front face;

said first connector includes a planar rear face;

said front face of said second connector and said rear face of said first connector abutting one another when said first and second connectors are mated;

said post extending outward from said front face of said second connector;

said catch means comprising a first shoulder extending transversely across the side of said post facing said latch plate when said first and second connectors are mated, said first shoulder having a planar surface spaced from and extending parallel to said front face of said second connector;

said latch surface comprising a second shoulder extending transversely across said latch plate proximate the end of said latch plate adjacent said rear face of said first connector, said second shoulder having a planar surface extending parallel to and spaced from said rear face of said first connector;

said second shoulder lying beneath said first shoulder with said planar surface of said second shoulder abutting said planar surface of said first shoulder when said first and second connectors are mated and said latch plate is in said first position.

3. A system as claimed in claim 2, wherein said securing means for pivotally joining said latch plate to said housing comprises:

an integral, flexible hinge joint;

said hinge joint extending transversely across said one end of said connector, one side edge of said hinge joint being joined to said one end of said first connector along a line spaced from said rear face of said first connector, and the opposed side edge of said hinge joint being joined to the surface of said latch plate facing said one end of said first connector along a line spaced from said second shoulder on said latch plate.

4. A system as claimed in claim 2, wherein:

said latch plate is deflected to said second position by moving the end of said latch plate opposite said end of said latch plate having said second shoulder formed thereon in a direction away from said one end of said first connector.

5. A system as claimed in claim 4, wherein said U-shaped handle and said means for pivotally connecting said handle to said first connector comprise:

a wire bail, the opposite end portions of said bail being bent to form two legs extending in parallel from and at right angles to the middle portion of said bail, the free ends of said legs each being bent to form an open center loop at the ends of said legs;

a pair of pivot pins, one each of said pins being passed through the center of each of said loops at said leg ends, said pins being fixed within said first connector along a line spaced from said one end of said connector by a distance such that, when said bail is pivoted to said position flush with said first connector, said middle portion of said bail extends over the outer surface of said latch plate at the end of said latch opposite said end of said latch plate having said second shoulder formed thereon, whereby said latch plate is restrained against said motion to said second position.

6. A system as claimed in claim 5, wherein:

said first connector includes a planar front face extending parallel to and spaced from said first connector rear face, said first connector further including a pair of parallel channels, one each of said channels intersecting one each of said pivot pins, each of said channels sloping from the locations of said pivot pins in said first connector and opening through said one end of said first connector near the edge of said one end adjacent said front face of said first connector, each of said channels opening through side front face of said first connector along the lengths of each said channel, whereby each of said legs of said bail lie below the surface of said front face of said first connector when said bail is pivoted to said position flush with said first connector.

7. A system for locking a first article to a second article in latched relationship, said articles being of the type matable upon being moved together in a selected direction, the second article being fixedly mounted to a panel and the first article being matable with and removable from the second article, said first and second articles having means operative to restrain said mated articles against relative motion in a direction orthogonal to said selected direction when said articles are mated, said system comprising:

a latch plate of said first article coextending parallel to said selected direction from a securing means forwardly to a free end, said free end including a rearwardly facing latch surface thereon, and said securing means pivotally joining said latch plate to one end of said first article to permit deflection of said latch plate from a first position to a second position proximate said first article in a manner transverse to said selected direction;

a post fixed to said second article at a position opposite said latch plate when said first and second articles are mated, said post including a rearwardly facing catch means;

said latch surface on said free end of said latch plate engaging said catch means to restrain said first and second articles against relative motion opposed to in said selected mating direction when said latch plate is in said first position;

said latch surface disengaging said catch means to free said first and second articles for relative motion in said opposed direction when said latch plate is deflected to said second position;

a U-shaped handle; and means for pivotally attaching said handle to said first article to permit said handle to be moved to a position extending outwardly from said first article for use as a handle, and to permit said handle to be moved to a flush position with respect to said first article for use as a latch lock, a portion of said handle engaging a rearward portion of said latch plate when said handle is in said flush position to secure said rearward portion against lateral movement away from said first article and prevent deflection of said latch plate to said second position.

* * * * *